US005424518A

United States Patent [19]

Gustafsson

[11] Patent Number: 5,424,518

[45] Date of Patent: Jun. 13, 1995

[54] DEVICE FOR APPLYING HEATED AIR TO A CAVITY USING MICROWAVE GENERATORS

[76] Inventor: Per E. Gustafsson, Stjarnvagen 26, S-541 55 Skovde, Sweden

[21] Appl. No.: 70,477

[22] PCT Filed: Dec. 16, 1991

[86] PCT No.: PCT/SE91/00864

§ 371 Date: Jun. 10, 1993

§ 102(e) Date: Jun. 10, 1993

[87] PCT Pub. No.: WO92/11497

PCT Pub. Date: Jul. 9, 1992

[30] Foreign Application Priority Data

Dec. 17, 1990 [SE] Sweden ..... 9004018

Feb. 6, 1991 [SE] Sweden ..... 9100368

[51] Int. Cl.[6] ..... H05B 6/64

[52] U.S. Cl. ..... 219/757; 219/681; 219/717

[58] Field of Search ..... 219/10.55 R, 10.55 A, 219/10.55 B, 400, 681, 757, 761, 717; 126/21 A, 21 R; 34/1 J, 1 L, 1 N, 1 P

[56] References Cited

U.S. PATENT DOCUMENTS

| | | | |
|---|---|---|---|
| 3,867,607 | 2/1975 | Ohtani | 219/10.55 B |
| 4,100,463 | 7/1978 | Sugie | 219/10.55 R |
| 4,332,993 | 6/1982 | Shibahara et al. | 219/10.55 R |
| 4,334,136 | 6/1982 | Mahan et al. | 219/681 |
| 4,405,850 | 9/1983 | Edgar | 219/10.55 A |
| 4,510,361 | 4/1985 | Mahan | 219/757 |
| 4,786,774 | 11/1988 | Kaminaka | 219/10.55 R |
| 4,956,531 | 9/1990 | Braunisch et al. | 219/10.55 B |
| 5,166,487 | 11/1992 | Hurley et al. | 219/10.55 R |

FOREIGN PATENT DOCUMENTS 9000713 1/1990 WIPO .

*Primary Examiner*—Philip H. Leung

*Attorney, Agent, or Firm*—Cushman, Darby & Cushman

[57] ABSTRACT

A complete unit for simultaneous production of warm air and microwave energy is ready for delivery. The device contains three transmitters with wave-guides (8) for microwave energy, power components (9) and a fan (10). The fan blows cooling air past the power components and transmitters. The heated air can be used for removal of the water, that the microwave transmitters vaporize. The device can easily be moved from one cavity to another. With three transmitters connected one on each phase a balanced load of the mains is achieved. An induction motor drives the fan.

2 Claims, 2 Drawing Sheets

DEVICE FOR APPLYING HEATED AIR TO A CAVITY USING MICROWAVE GENERATORS

TECHNICAL FIELD

Many products have to be dried after some treatment. For this hot air, infra-red radiation and lately microwave energy has been used. This treatment is usually performed in especially built rooms or volumes. With a permanent built in equipment those rooms will become more or less complicated as they have been designed for a specific use. The object of the present invention is to present a device, that is easy to move between different rooms for treatment and at the same time consumes as little energy as possible.

BACKGROUND ART

Airhandling has been well known a long time. Heating of air is also well known. Recently different kinds of treatment with microwave energy have come in use. Firstly those equipments were designed for a certain technical function or room.

The present invention start from some of those known technical solutions and presents a low cost device for the generation of energy, where microwave energy as well as warm air is used. Those two kinds of energy are combined in an electrically ideal way.

SUMMARY OF INVENTION

It is especially characteristic for the invention that microwave energy and cooling air from its generation cooperate in a cavity, where microwave energy is the predominant kind of energy to be used for some operation like drying of paint or glue.

Known transmitters of microwave energy consume comparatively much power. A highly developed cooling is therefore needed. It is characteristic for the invention that the device has one or more fans for air transport past microwave transmitters. This characteristic is enlarged with the need of air for transport of aqueous vapour from the treated objects. Typical for the device is, that the fans are designed to match this need of watertransport in a way that for cooling much oversized fans will be used, where the evaporation of water is large.

An other distinctive mark is, that the whole device can be manufactured to a complete working unit, which furnish microwave energy as well as heated cooling air. All needed equipment for the time and humidity control can be found installed. This means that it will be easy to move the device for operation from one cavity to another, which means great economical advantage.

Normally electric motors are run on three-phase current, induction motors. In order to avoid an unbalanced line load, the most advantageous device consists of three microwave transmitters so connected to the fan motor that a totally balanced load will be obtained. With three suitably connected transmitters low mutual disturbance will occur.

An other characteristic for the invention is that due to standardization to rather small outputs, a massproduction and use of the invented device will result in, that the number of devices and not the their output will become design quantity.

BRIEF DESCRIPTION OF DRAWINGS

A typical example of the invented device is shown schematically in perspective from above in FIG. 1 and turned over in FIG. 2.

DETAILED DESCRIPTION OF THE INVENTION

Figure 1:
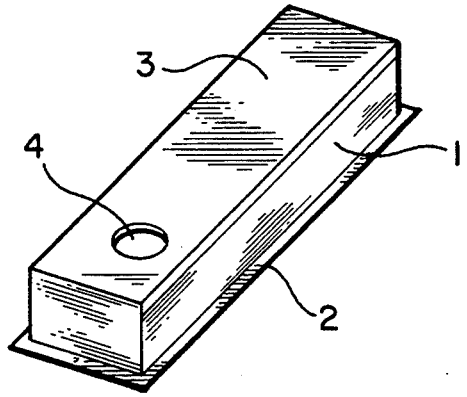
Figure 2:
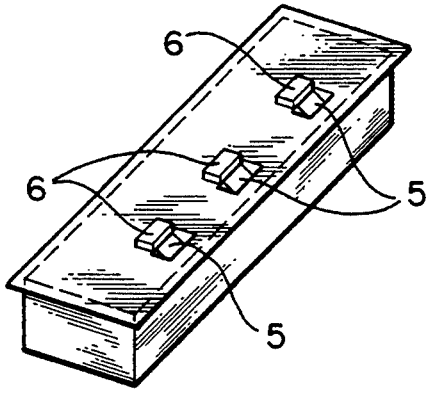

FIG. 1 shows an ordinary design of the invented device. One sees a long narrow box 1, which has flanges 2 in the bottom, and a cover 3. In the cover there is a hole 4. If the box, that is shown schematically in perspective in FIG. 2, is turned over, three netting covered holes 5 and three protruding pipes 6 with rectangular cross section will be seen. The latter are the mouths of the microwave transmitter's wave-guides.

Figure 3:
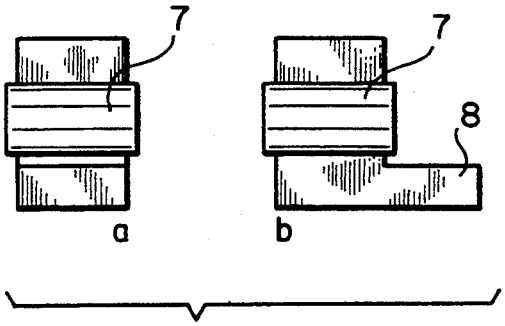
FIG. 3 shows very schematically the outer contours of a microwave transmitter with its microwave-guide or antenna installed.

In FIG. 3 the outer contour of a typical microwave transmitter is shown. Skilled men know, that usually a magnetron is the source of the microwave energy. Normally it is surrounded by cooling flanges 7, which in the figure is shown schematically as thin lines. There should be a driving component for the magnetron and a wave-guide 8. The wave-guide surrounds the apex of the magnetron. In FIG. 3, the wave-guide in view "a" is facing the observer. The rectangular cross section should especially be noticed.

Figure 4:
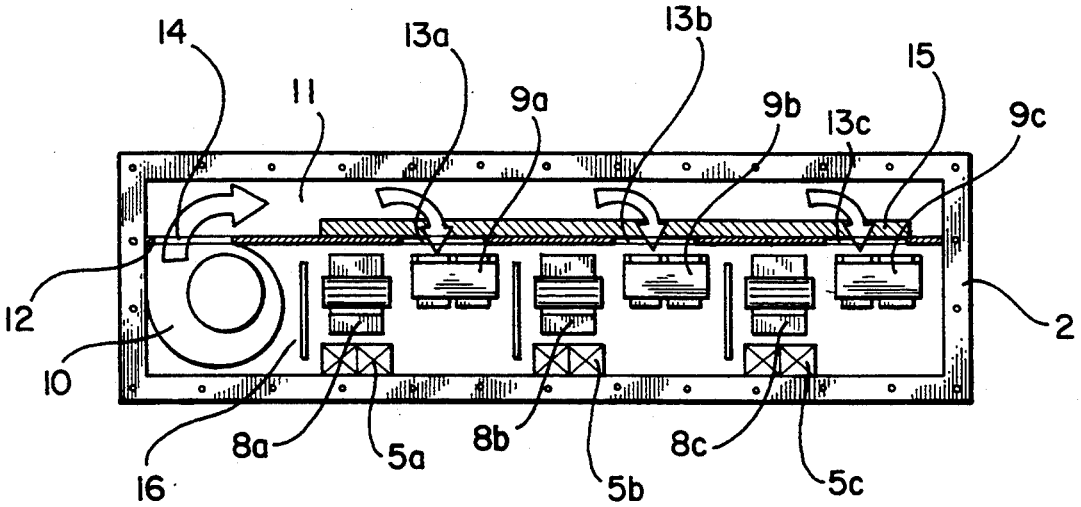
In FIG. 4 the cover of the device is taken away, and it is possible to look into it.

In FIG. 4 the box shown in the FIGS. 1 and 2 can be seen without the cover 3. The box contains three transmitters for microwaves. Each of them has a wave-guide 8, that protrudes through the bottom of the box and is microwave-tight connected to the bottom of the box. Adjacent to the transmitters there is one power and one driving outfit, 9, to be found. To this should be added some condensers, which are not shown. The very transmitter of microwaves and its driving outfits are well known components and are not as such included in the invention. In the box there is also a fan 10 to be found. This fan sucks air from the environs through the hole 4 of the cover in the box and further out in a duct 11 along one side of the box. The duct is formed by a wall 12. In this wall there are apertures 13 for cooling air and 14 for air from the fan 10. An ordinary radial fan is displayed, but axial fans can be used.

From the duct 11 air is pushed through the apertures 13 passing the power components on its way to the transmitters of microwaves and their cooling flanges and then out through the holes 5. Those holes are open for air but tight for microwave energy. They can be made of perforated plate preferably of aluminium, but wire netting with matching mesh can also be used. Skilled men know about those tightness questions.

For the protection of transmitters and power components it has been found useful to cover the apertures 13 with filter cloth 15. As support for the filter a netting over the apertures 13 can be used.

To distribute the cooling air through the box in a way, that all units get enough cooling, particular flow guides might be needed. In FIG. 4 those flow guides are marked 16.

The box 1 can be fastened to a cavity by some known method. In FIG. 4 a rather durable bolt connection is indicated, the holes of which in the flange are shown i the figure. If the box is to be moved frequently there are other know methods for the fastening. It is however important, that the box is connected to every cavity in a microwave-tight way, when it is to be operated.

Naturally a switch board for the electrical connection and control also belongs to the equipment. Those components are so well known, that they are not needed in the figures. Obtaining a balanced load of the main power supply is however a characteristic feature of the invention. This is achieved, as FIG. 4 discloses, through star or delta connection of three microwave transmitters, one per phase, combined with one three-phase motor. A result of this is, that the microwave transmitters do not mutually interfere, as they have their maximum output timed out of phase.

The electrical phase difference of 120 degrees between maximum output for the different transmitters might also be used in a way, that different maximum outputs from the transmitters can be foreseen, as they do not mutually interfere and back radiation is eliminated. Although equal output power from all the three transmitters is a general goal, in some cases it might be advantageous with a possibility to adjust the power to the objects, which are to be dried. This can be achieved through a disconnection of one or two microwave transmitters. Sometimes this possibility to control the total output can be valuable.

As all needed equipment for the production of energy is installed in a small box, the device will be completed already at the producing factory ready for further installation on any cavity. This has the advantage, that an individual box can be used on different cavities, if the mechanical connection to the cavity is made microwave-tight. Alumina coated tape can be used, if the cavity does not have microwave traps. Those are known by the man skilled in the art.

Its has proven advantageous to produce series with relatively low output of microwave energy. For larger need of power one uses several boxes with transmitters. A result is naturally larger series but also a possibility to distribute the energy over larger surfaces. This is especially brought to light in big plants for moving products, where the time element can be of importance. With several transmitters along a moving web for instance of paper one gets a possibility to furnish different amounts of energy over a great distance, and can run the web at high speed and get a uniform heating. Printed paper, veneered particle board and glued wood belong to the products, which can be treated with microwave energy and the associated hot air for the removal of vaporized water.

The need for cooling air to the microwave transmitters and their power components is one design size for the built in fan in the box. This quantity of air is a minimum needed fan capacity. Knowing the need of water vapour removal a matching air capacity can be added, when designing the fan. The whole can be built into the box 1. As it is advantageous normally, to run the microwave transmitters and their power components at an undeviating temperature, some throttles for the cooling air control might be required. Skilled men know about how to install those throttles. Different kinds of regulators might also be needed.

Figure 5:
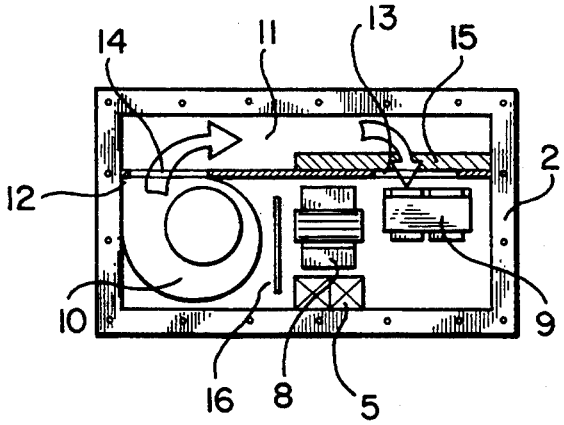
FIG. 5 shows a modification of the device. Finally

It could be of advantage, when large quantities of air and energy is required, to split the box and use a units like that shown in FIG. 5. This alternative is however inferior to that in FIG. 4. Important is that three units of the latter type are used together, if the load advantage with three-phase, characteristic for the invention, shall be realized.

It has been disclosed in the figures that the fan 10 is situated near a row of microwave transmitters, but this is only one of many successful positions, which are covered by the following claims. The fan might also be positioned above the transmitters and blow down its air in a duct 11, like that in FIG. 4.

When very large amounts of hot moisture carrying air is required, any known equipment for further heating of the cooling air from the box, can be installed outside the netting covered holes 5, which are microwave-tight.

In the Swedish patent application SE 900 3703-7 a spraying chambers is disclosed, in which microwave energy can be used for the drying of paint. It is characteristic for the invention, that a device of present design can be used on several chambers. After that a cord has been connected to the device and the chamber is adapted to the box, devices can be moved from one chamber to another when required.

In FIG. 6 is shown a set up where one microwave device is used on two chambers. The figures are taken from the mentioned Swedish patent application. FIG. 6*a* thus shows a suitable designed chamber. Characteristic for this chamber is the lack of parallel surrounding surfaces around a working volume A, which means, that stationary waves will be avoided. In FIG. 6*b* two chambers have been put beneath each other. To that is added a cover for one of the working volumes. The cover is shown as a separate unit 20 in this figure. It is this cover, that well exemplifies the possibility to move the invented energy transmitter from one volume to another.

Figure 6A:
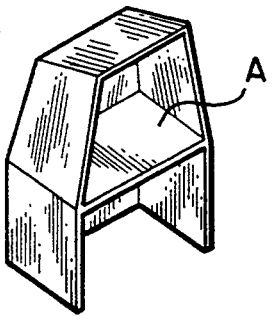
FIGS. 6*a*, 6*b*, 6*c* and 6*d* show the invented device in a realistic mode of use.
Figure 6B:
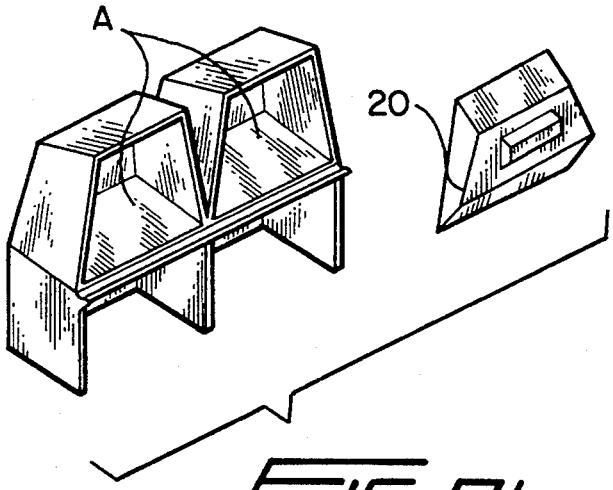
Figure 6C:
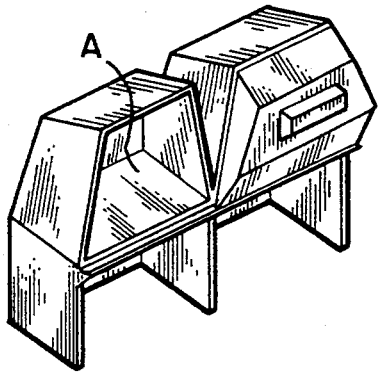

The cover is mounted in FIG. 6*c*. The right chamber could for instance be used for drying of paint whereas the in the other, the left, a dried product is taken out, a new is set in and treatment of this new object will proceed. After the treatment in the left chamber the product in the right chamber will normally be dried and the cover can easily be moved from one chamber to the other. The working sequence is repeated and the box is moved again from chamber to chamber.

Figure 6D:
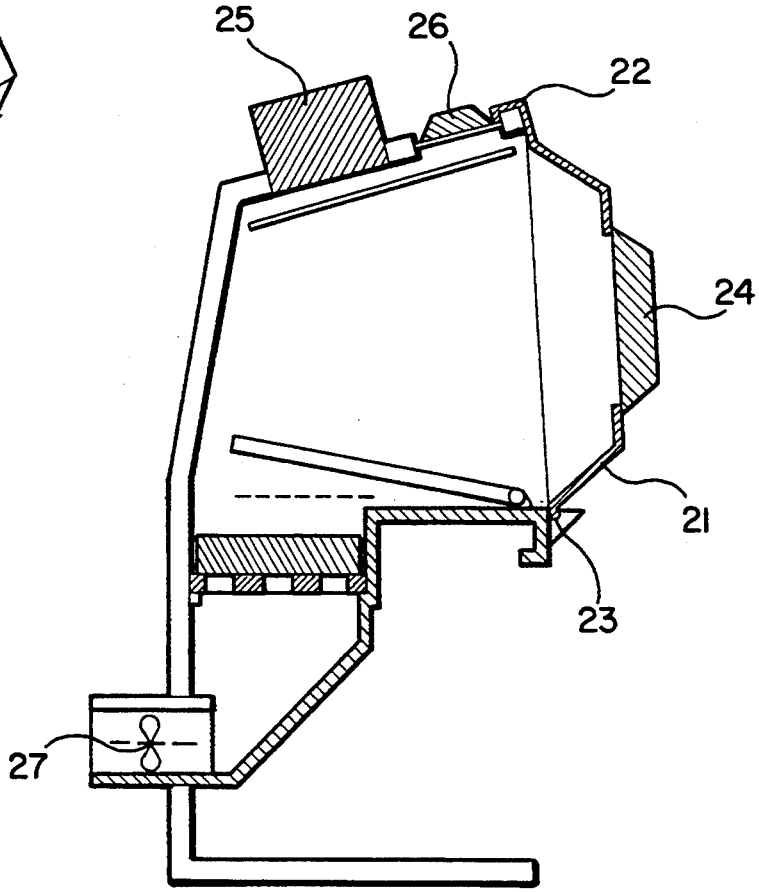

In FIG. 6*d* a section of a chamber is displayed. Its aperture to the right is closed by a cover 21. In the figure this cover is hung at the upper edge on a rail 22 and resting on its lower edge in a slot 23. The other two edges of the cover are connected to the outer frame of the chamber in a microwave-tight way. In the cover a device 24 for microwave energy is tightly mounted. Other generators 25 of microwave energy might also be found in each chamber, but generally those are not needed. The fan from the invented box often makes the fan 27 in the chamber needless. Now a pushing fan is used instead of a sucking. Other combinations of fans are covered by the following claims. The displayed arrangement is naturally only an example of how the invented device for microwave energy can be used as part of a cover or door to a large volume.

Typically for the method is, that several essentially equal devices can be used together on one cavity. It will thus be possible to produce those devices in larger series than it would if they were produced individually adapted to special requirements.

INDUSTRIAL APPLICABILITY

The invention implies a rationalization of the manufacturing of generators for microwave energy. Instead of designing and adapting every generator to the individual need, one chose a number equal and complete smaller devices, which can be manufactured in large series. As the complete device can easily be moved, one gets a inexpensive possibility to use microwave energy on several places in an enterprise.

I claim:

1. A device for the simultaneous treatment of objects with warm air and microwave energy where the objects are disposed in a microwave tight cavity having an opening in a wall to which opening said device is to be attached, said device comprising a container having a removable cover and a base wall, three spaced apart openings in said base wall, a microwave generator disposed in said container adjacent each said opening, a wave guide mounted adjacent each said microwave generator, said container having internally an air duct having a plurality of openings each located adjacent one of said microwave generators, a fan disposed in said container for drawing outside air into said duct through an aperture in said container and for moving the air through said openings whereby the air will become heated by removing heat generated by the operation of said microwave generators, one of each of said openings in said base wall being located adjacent each said wave guide to allow heated air to flow therethrough, each said opening in said base wall having a microwave blocker to prevent escape of microwave energy, said openings provided in said base wall each having a said wave guide adjacent thereto, said microwave generators being connected to a three-phase power supply.

2. The invention as claimed in claim 1 wherein each said opening in said duct is provided with a dirt collecting filter cloth.

* * * * *